United States Patent [19]

Kinnan

[11] Patent Number: 4,661,018

[45] Date of Patent: Apr. 28, 1987

[54] APPARATUS FOR AND METHOD OF INSTALLING UNDERGROUND CABLE HAVING ABOVE GROUND TERMINALS

[75] Inventor: Frank R. Kinnan, Douglas County, Oreg.

[73] Assignee: Electric Power Research Institute, Inc., Santa Clara County, Calif.

[21] Appl. No.: 862,847

[22] Filed: May 13, 1986

Related U.S. Application Data

[63] Continuation-in-part of Ser. No. 269,954, Jun. 3, 1981, abandoned.

[51] Int. Cl.[4] ..... E02F 5/10; H02G 9/00

[52] U.S. Cl. ..... 405/178; 405/180

[58] Field of Search ..... 405/174, 177, 178, 180, 405/181, 183

[56] References Cited

U.S. PATENT DOCUMENTS 3,429,134 2/1969 Coffey ..... 405/177 X
3,849,999 11/1974 Coffey ..... 405/178
3,851,489 12/1974 Richardson ..... 405/178

FOREIGN PATENT DOCUMENTS 2313619 12/1976 France ..... 405/180

*Primary Examiner*—David H. Corbin
*Attorney, Agent, or Firm*—Flehr, Hohbach, Test, Albritton & Herbert

[57] ABSTRACT

An apparatus for installing cable underground is disclosed herein along with its method of operation. The apparatus utilizes a power driven land vehicle and a cable laying plow blade supported by and for movement with the vehicle in a way which places a bottom end portion of the blade in the ground so as to plow through the soil. A supply of cable is also supported on and movable with the vehicle along with a cable feed arrangement cooperating with the blade for laying a continuous length of the cable from its supply into the ground at a fixed depth relative to and along the path of the plow blade. The feed arrangement itself includes a feed shoe which makes it easy to bring up to ground level intermittent sections of the cable as the latter is installed and without withdrawing the plow blade. These spaced above ground cable sections serve as terminals for ready access to the buried cable.

16 Claims, 6 Drawing Figures

APPARATUS FOR AND METHOD OF INSTALLING UNDERGROUND CABLE HAVING ABOVE GROUND TERMINALS

This application is a continuation-in-part of U.S. application Ser. No. 269,954, filed June 3, 1981, now abandoned.

This invention relates generally to apparatus for installing cable underground and more particularly to a specifically designed cable feed shoe for use with such apparatus and its method of operation in which the cable being installed underground can be brought readily to ground level so as to be terminated or to serve as an above ground terminal.

One present method of installing electrical cable underground is to utilize a power driven land vehicle in combination with an elongated cable laying plow blade and a cable feed mechanism. The plow blade is supported by and for movement with the vehicle in a way which places a lowermost end portion of the blade in the group with its cutting edge disposed in the direction of movement of the vehicle. At the same time, a feed mechanism continuously feeds a supply of cable to an in-ground point on the blade and from there into the ground along the path taken by the blade as it moves with the vehicle. An example of an apparatus of this type may be found in co-pending U.S. patent application Ser. No. 269,955, filed June 3, 1981, entitled Underground Cable Installing Apparatus and Method Utilizing a Multi-positionable Plow Blade, and is assigned to the same Assignee as the subject application. The particular and preferred plow blade arrangement is described in co-pending U.S. patent application Ser. No. 269,968, filed June 3, 1981, entitled Underground Cable Installing Apparatus and Method Utilizing a Fluid Jet Assisted, Vibrating Blade Arrangement, assigned to the same Assignee as the subject application.

While specific techniques for installing underground cable described generally above and in the specifically recited applications are satisfactory for their intended purposes; that is, to bury underground cable, none of these techniques have addressed the task of providing a given underground cable with spaced-apart, above-ground sections for use as terminals. One typical way of accomplishing this is to retrieve the desired sections of the cable from the ground after the latter has been buried in its entirety. It should be obvious that this could be quite laborious and time consuming, and therefore costly. A second, more common way to do this is to follow directly behind a cable installing apparatus of the type described above and manually retrieve sections of the cable as the latter is installed. Unfortunately, even when following directly behind the cable installing apparatus, the cable itself is not usually accessible from ground level as it is installed. This is because the plow blade cuts a relatively thin trench as it moves through the earth and this thin trench fills in on itself almost immediately behind the blade. Therefore, it is necessary even when following behind the plow blade to dig up the earth to retrieve the desired cable sections.

In view of the foregoing, it is a primary object of this invention to provide a means for and method of retrieving spaced sections of underground cable so as to bring the retrieved cable sections to ground level without having to dig through the earth and without removing the blade from the earth.

Another primary object of this invention is to install one or more cables underground and to selectively retrieve one or more of these cables so to terminate them without having to dig through the earth and without having to remove the blade.

Such apparatus may be particularly useful in wiring a subdivision with underground telephone and power lines. Such lines may both be in the same trench; however, they will usually be terminated at different places. The telephone lines or secondary power cables or cable television will need to be terminated at each house, making frequent access to the lines without interruption of the trenching process important. The primary power cables will be terminated only intermittently, at transformers which are not typically located at the telephone termination points.

A more particular object of the present invention is to provide a specifically designed cable feed shoe mechanism for use with an underground cable installing apparatus of the type described generally above and in the two recited co-pending patent applications for carrying out the last-mentioned objects.

Another particular object of this invention is to provide a cable feed shoe which is uncomplicated in design, economical to provide and reliable in use.

Still another particular object of this invention is to provide a cable feed shoe which not only serves to carry out the first-mentioned object by the specific way in which it aids in feeding a given cable into the ground but which also aids in simultaneously feeding a second cable into the ground and specifically one which is not to have sections at ground level.

As will be described in more detail hereinafter, the underground cable installing apparatus disclosed herein is one which utilizes a power driven land vehicle in combination with an elongated cable laying plow blade, a supply of cable and a cable feed mechanism. The blade is supported by and for movement with the vehicle in a way that places a lowermost end portion of the blade in the ground with its cutting edge disposed in the direction of movement of the vehicle. At the same time, the feed mechanism continuously feeds a supply of cable to an in-ground point on the blade and from there directly into the ground a fixed depth relative to and along the path of the blade. In accordance with the present invention, the feeding mechanism includes a feed shoe mounted on the blade at the point just mentioned for movement therewith. The feed shoe itself utilizes a cable guide means which operates in a first position for receiving the cable to be installed from its supply and for guiding it in the ground at the appropriate depth as the vehicle and blade move. Means are also provided for supporting the guide means for movement between its first in-ground operating position and a second higher position which makes a section of the cable directly under the guide means accessible from ground level without digging through the earth. In this way, successive cable sections can be manually pulled up to ground level and maintained in these above-ground positions for use as terminals without pulling the blade out of the ground and again, without digging through the earth. Moreover, any given cable can be readily terminated in the same way.

The overall underground cable installing apparatus and particularly its cable feed shoe will be discussed in more detail hereinafter in conjunction with the drawings, wherein.

Figure 1:
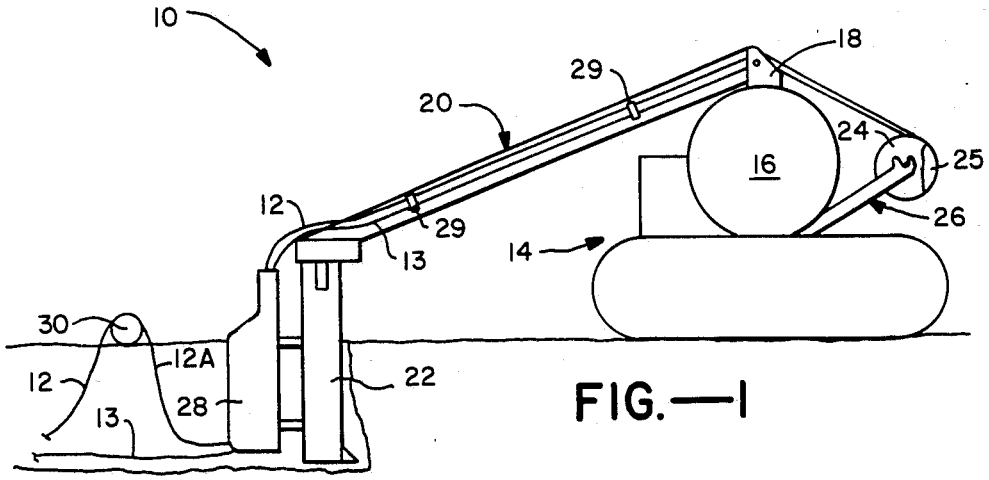
FIG. 1 is a side elevational view illustrating an apparatus for installing cable underground and specifically one which utilizes a cable feed shoe designed in accordance with this invention.

Turning now to the drawings, attention is first directed to FIG. 1 which illustrates an overall apparatus 10 for installing two cables 12 and 13 underground. The cables can be flexible electrical cables, conduit, telephone lines, hoses and the like or more rigid piping. As used herein, the term "cable" refers to all of these items. The apparatus includes a power driven vehicle 14 such as the tractor illustrated, which vehicle includes a main housing unit 16 for containing the appropriate controls as well as other components necessary to the operation of the overall apparatus. Main unit 16 carries on its top side a tower 18 which, in turn, supports one end of a boom arrangement 20. The other end of the boom arrangement supports a cable laying plow blade arrangement 22 which is described in more detail in the second mentioned pending application recited above.

Main unit 16, tower 18, and boom arrangement 20 together support plow blade 22 for movement with vehicle 14 and also relative to vehicle 14 between at least two positions, an in-ground cable laying first position as shown in FIG. 1 and an inoperative second position immediately above the ground. In a preferred embodiment, main unit 16, tower 18 and boom arrangement 20 are designed to maneuver the plow blade between a much greater number of positions than the two mentioned, as described in the first mentioned pending application recited above. In addition to the various components and arrangements discussed thus far, overall apparatus 10 includes two cable reels 24 and 25 or like means for containing respective supplies of cable 12 and 13 (independently feedable) and suitable means generally indicated at 26 for supporting the two reels on and for movement with vehicle 14. A cable feed mechanism or shoe generally indicated at 28 cooperates with the two cable supplies for feeding cables 12 and 13 from their respective supplies to an inground point on the blade and from this point into the ground a fixed depth relative to and along the path of blade 22. In the particular embodiment illustrated, cable 12 and 13 are slidably supported from their respective reels 24 and 25 through tower 16 and along boom arrangement 20 by suitable means generally indicated at 29 and into the feed shoe 28 which is mounted to blade 22 directly behind and adjacent to the latter.

As will be seen, cable feed shoe 28 is designed in accordance with the present invention to simultaneously guide the two cables 12 and 13 into their inground positions at the appropriate depth relative to the plow blade. However, the feed shoe is designed to make intermittent sections of cable 12 readily accessible from ground level as the cable is buried without having to withdraw the plow blade and without having to dig up the soil surrounding these sections as required in the past. In this way, intermittent sections of cable 12 can be readily retrieved and brought to ground level to serve as terminals. One such section is illustrated in FIG. 1 and generally indicated by reference numeral 12*a*. This section is held in place above ground by suitable means such as a mandrel or the like 30 disposed through the upwardly projecting loop made by the section above the ground. Eventually, this section and like sections are converted to a readily accessible terminal generally indicated by dotted lines at 32. In fact, the mandrel is typically a template of sufficient size to define the length of the loop to be pulled above the ground to form the termination.

Figure 2:
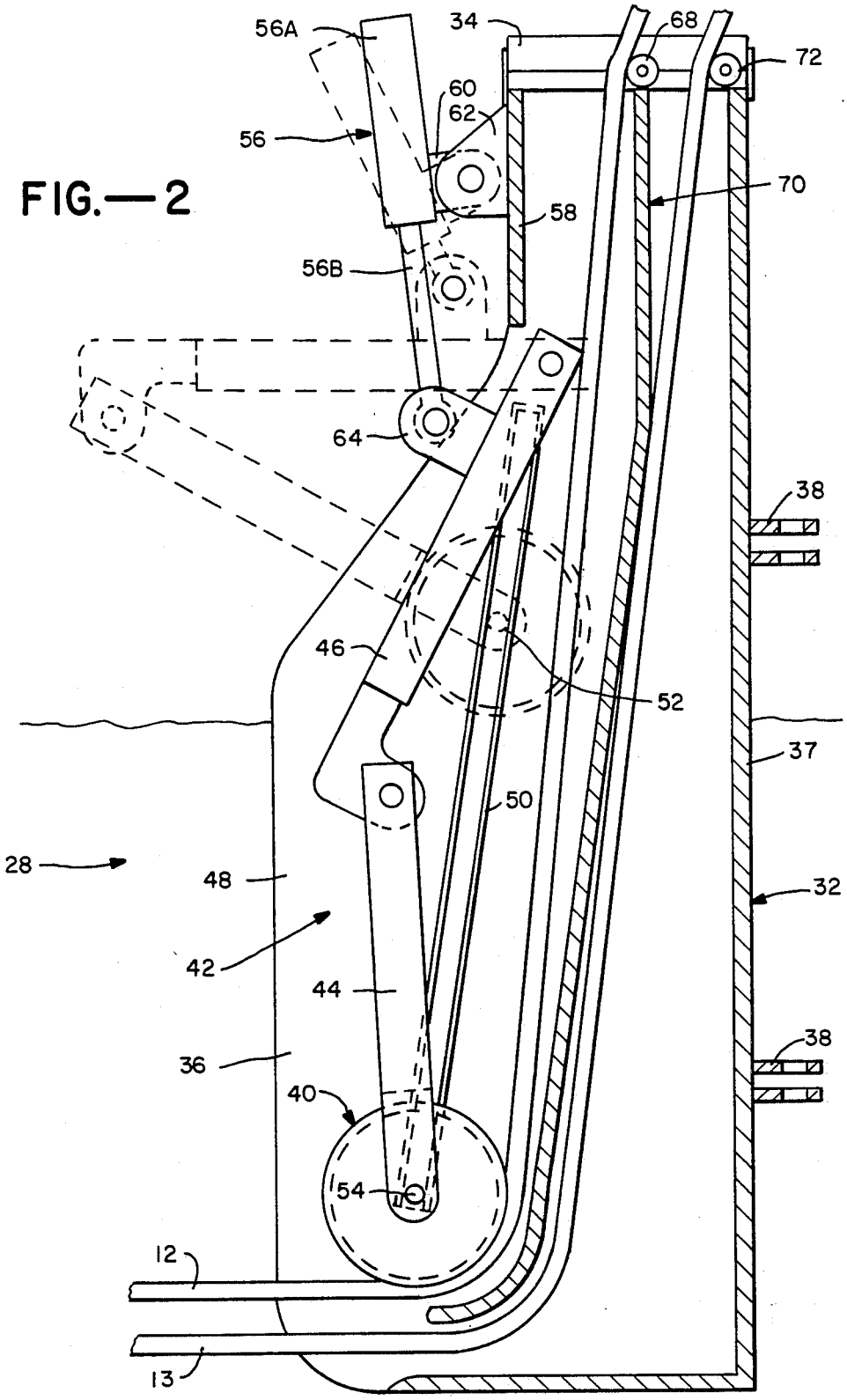
FIG. 2 illustrates in vertical section a detailed construction of the cable shoe shown generally in FIG. 1.

Turning to FIG. 2, attention is directed to the components making up cable feed shoe 28. As seen in this figure, the shoe includes a vertically extending main housing 32 which is somewhat elongated in shape and which includes an opened top end 34 and an opened back 36. The front of the housing which is closed by means of a front plate 37 serves to support a plurality of mounting brackets 38 for connecting the housing to the back side of blade 22 in the position illustrated in FIG. 1.

In addition to housing 32 and mounting brackets 38, overall cable feed shoe 28 includes a shive 40 which is supported within housing 32 by a support arrangement generally indicated at 42. This arrangement includes a first lower elongated link 44 which supports the shive 40 at its bottom end for rotation about the axis of the shive which extends horizontally. The top end of link 44 is pivotally connected to the bottom end of a second upper elongated link 46 which is, in turn, pivotally connected at its top end to the inner surface of a side wall 48 of housing 32. In this way, the shive is movable between a lowermost position within housing 32 as illustrated by solid lines and an uppermost position within the housing as illustrated by dotted lines. In order to aid the shive in its movement between these two extreme positions, support arrangement 42 includes an elongated track 50 fixedly supported along the inner surface of side wall 48 in a slightly rearwardly inclined position from the vertical. A guide pin 52 indicated only by dotted lines in FIG. 2 is fixedly connected to the inner side of shive 40 co-linear with its axis of rotation. In actual practice, the guide pin may form an extension of the axle of the shive, which axle is generally indicated at 54. The guide pin is disposed within track 50 and thereby limits the positional movement of shive 40 to a straight line along the track.

In order to actually move the shive between its two extreme positions, support arrangement 42 includes a piston assembly 56 which may be electrically, hydraulically or pneumatically actuated. As seen in FIG. 2, the assembly 56 has its outer cylinder 56A mounted for limited pivotal movement of a top rearwardly facing wall 58 of housing 32 by means of cooperating flanges 60 and 62. The piston component 56B of assembly 56, that is, the component of the overall assembly which is movable between an extended and a retracted position, has its free end pivotally connected to a top end section of link 46 by means of a flange 64. In actual operation, when piston 56B is in its extended position, the shive 40 is maintained in its lowermost position. As the piston component moves to its retracted position, it pulls the upper link upwards to a somewhat horizontally extending position causing the lower link to move upwards to a forwardly and upwardly inclined position which, in turn, causes the shive to move up track 50.

Figure 3A:
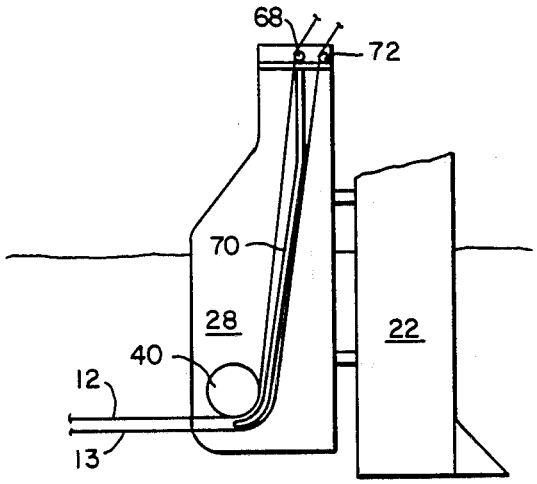
FIGS. 3A-3D illustrate diagrammatically how the cable feed shoe shown in FIG. 2 operates in accordance with the present invention.

The primary purpose for shive 40 is to insure that cable 12 moves smoothly into the ground as plow blade 22 cuts through the earth. To this end, cable 12 is fed from its supply 24 through tower 18 and across boom arrangement 20, as indicated above, and eventually into housing 32 through its top opening 34. To this end, a guide roller 68 is suitably mounted in the appropriate position across opening 34. Cable 12 enters the housing across this guide roller and thereafter passes under and against shive 40 and out through the back opening 36 and into the undergound trench formed by plow blade 22, that is assuming that the shive is in its lowermost operating position. This is best illustrated diagrammatically in FIG. 3A.

Figure 3B:
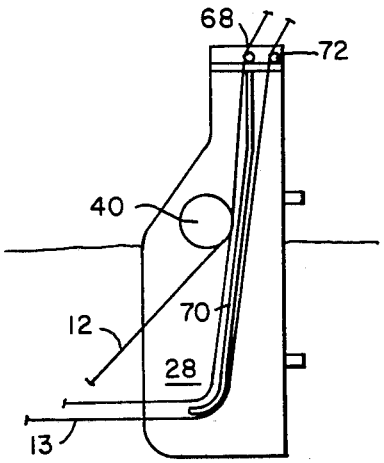
Figure 3C:
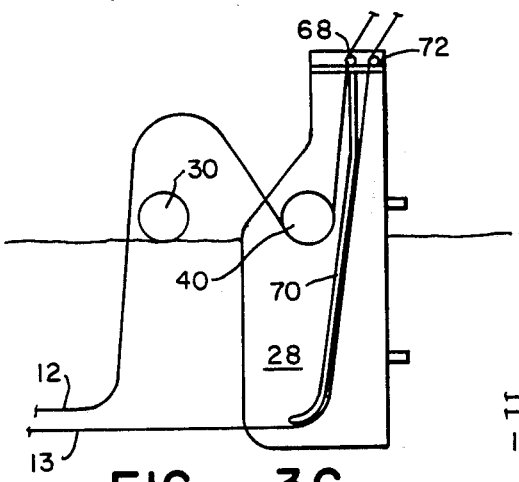
Figure 3D:
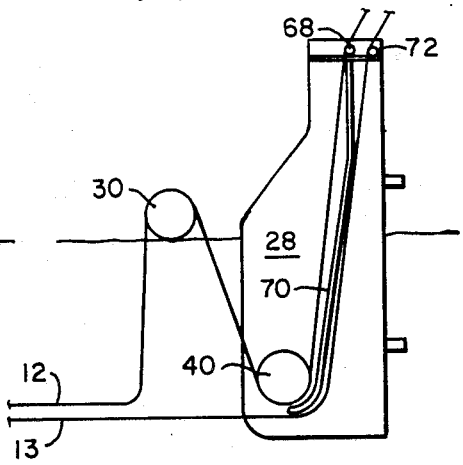

At any desired point along cable 12 during its installation, it may be desirable to provide one of the previously recited above ground terminals 32. In order to do this using feed shoe 28, the vehicle 14 is preferably shopped and the shive 40 is moved from its lowermost position in FIG. 3A to its raised position best illustrated diagrammatically in FIG. 3B. Note that when the shive is in its lowermost position (FIG. 3A) the section of cable 12 immediately behind the shive is located at the bottom of the trench formed by blade 28 and, more than likely, inaccessible without digging through the earth. On the other hand, when the shive is moved to its uppermost position as in FIG. 3B, a section of cable 12 behind the shive is quite accessible from above ground by merely reaching into the housing just below the shive through opening 36 where the cable 12 will be hanging down in front of separating plate 70. As a result, the accessible section of the cable which will be designated by the reference numeral 12*a* to conform with FIG. 1 is pulled up to the ground in the form of a loop, as seen in FIG. 3C by pulling additional cable 12 off drum 24. While a topmost segment of this loop is well above the ground, a mandrel or the like 30 is placed on the ground within the loop to define the size of the loop and prevent the latter from being pulled back into its trench when the shive is returned to its lowermost position as in FIG. 3D pushing cable 12 with it. In this regard, when cable section 12*a* is pulled out of the ground initially, the loop formed should be sufficiently large so that when shive 40 is returned to its lowermost position, the loop will close onto the mandrel 30 in a vertically extending fashion as shown in FIG. 1.

From the foregoing, it is readily apparent that blade 22 does not need to be withdrawn from the ground to provide cable section 12*a* or any other cable sections and, other than momentarily stopping vehicle 14, the overall operation of apparatus 20 is not interfered with. Moreover, access to cable section 12*a* or any of the other cable sections to be retrieved does not require digging up the soil.

In addition to serving as a guide for cable 12 and a means for easily gaining access to intermittent sections of the cable, feed shoe 28 serves as a guide for previously recited cable 13. As best seen in FIG. 2, the feed shoe includes a separating plate 70 disposed within housing 32 and extending downward from the top end of the housing in a somewhat vertically extending, slightly angled fashion. The separating plate preferably extends entirely between the side walls of the housing, that is, side wall 48 and its opposition side wall (not shown in FIG. 2). The separating plate is held in place by any suitable means and serves to separate the cable 12 as the latter passes through housing 32 from the cable 13 as it passes through the housing and also as a guide for cable 13. In this latter regard, as best seen in FIG. 2, cable 13 enters the housing 32 and is initially guided therein by guide roller 72. Thereafter, the cable moves along the forward facing side of the separating plate and out the back end of housing 32 under cable 12. As seen best in FIGS. 3A–3D, the movement of shive 40 between its lowermost position and its uppermost position does not affect the installation of cable 13 in any way. Therefore, one underground cable can be made to include above ground terminals and a second cable can be simultaneously installed without such provisions, providing for simultaneous installation of power and telephone cables, as described in the introduction hereinabove.

From the foregoing, it should be apparent that the overall feed shoe can be used not only to provide a series of terminals but also as a means of selectively terminating one or more cables as the latter are installed. Moreover, this can be done without removing the blade. For example, a series of electric cables, plumbing conduit and the like can be simultaneously installed starting at a common point. The plumbing conduit can then be terminated at a second point when the electric cables are extended to a third point. In addition, cable, conduit or the like does not have to be supplied from the moving vehicle, although this is preferred.

What is claimed:

1. An apparatus for installing cable underground, comprising:

a power driven land vehicle; a cable laying plow blade;

means supporting said blade for movement with said vehicle in a way which places a bottom end portion of the blade in the ground so as to plow through the soil;

means including a supply of cable supported on and movable with said vehicle; and means for feeding said cable from its supply to a point adjacent the bottom end portion of said blade and from said point into the ground a fixed depth relative to and along the path of said blade, said feeding means including a feed shoe mounted on said blade at said adjacent point for movement therewith, said feed shoe including cable guide means operating in a first position above said cable for receiving said cable from said supply and for guiding it in the ground at said fixed depth as said vehicle and blade move and means supporting said guide means for movement between said first position and a second higher position above said cable which makes a section of said cable directly under said guide means accessible from ground level, said guide means comprising a sheave slidable between first and second positions along a track mounted on said feed shoe whereby said cable section can be manually pulled up to ground level and maintained there without pulling said blade out of the ground.

2. An apparatus according to claim 1 wherein said supporting means includes an arrangement of links interconnected to one another, said sheave being connected to the end of said link arrangement and means for moving said links to move said sheave between said first and second positions.

3. An apparatus according to claim 1 including means providing a supply of second cable supported on and movable with said vehicle, said feeding means feeding said second cable from its supply to said point and from there into the ground at said fixed depth along with said first-mentioned cable, said shoe including means for guiding said secoond cable into the ground at said fixed depth regardless of the position of said movable cable guide means.

4. An apparatus according to claim 3 wherein said second cable guiding means includes a fixed plate serving to separate said first-mentioned and second cable from one another during their movement at said shoe.

5. A cable feed shoe for use in an underground cable installing apparatus which includes a power driven land vehicle, a cable laying plow blade, means supporting the blade for movement with said vehicle in a way which places a bottom end portion of the blade in the ground so as to plow through the soil, means including a supply of cable supported on and movable with the vehicle and means for feeding the cable from its supply to a point adjacent the bottom end portion of the blade and from said point into the ground a fixed distance relative to and along the path of the blade, said feed shoe forming part of said feeding means and comprising a main housing to be mounted on said blade at said adjacent point for movement therewith, cable guide means disposed within said housing and designed to operate in a first position above and in contact with said cable for receiving said cable from said supply and for guiding it into the ground at said fixed depth as said vehicle and blade move, and means supporting said guide means within said housing for movement between said first position and a second higher position above said cable to make a section of the cable directly under the guide means accessible from ground level, said guide means comprising a sheave slidable between first and second positions along a track mounted on said feed shoe, whereby the cable section can be manually pulled up to ground level and maintained there without pulling the cable laying plow blade out of the ground.

6. A cable feed shoe according to claim 5 including means disposed within and supported by said housing for guiding a second cable into the ground at said fixed depth regardless of the position of said movable cable guide means.

7. A cable feed shoe according to claim 6 wherein said movable cable guide means includes a sheave for engagement with said cable, wherein said supporting means includes an arrangement of links interconnected to one another and to said shive and means for moving said links to move said sheave between said first and second positions, and wherein said second cable guiding means including a fixed plate disposed within and supported by said housing so as to separate the first-mentioned and the second cable from one another during their movement at the shoe.

8. An apparatus for selectively installing a plurality of cables underground, comprising a power driven land vehicle;

a cable laying plow blade;

means supporting said blade for movement with said vehicle in a way which places a bottom end portion of the blade in the ground so as to plow through the soil;

means including a supply of each of said cables; and means for feeding said cables from their respective supplies to a point adjacent the bottom end portion of said blade and from said point into the ground a fixed depth relative to and along the path of said blade, said feeding means including a feed shoe mounted on said blade at said adjacent point for movement therewith, said feed shoe including cable guide means operating in a first position for receiving said cables from said supplies and for guiding them in the ground at said fixed depth as said vehicle and blade move, and means supporting said guide means for movement between said first position and a second, higher position which makes a section of each of said cables directly under said guide means accessible from ground level, said guide means comprising a sheave along a track mounted on said feed shoe between said first and second positions, whereby selective ones of said cable sections can be manually pulled up to ground level and maintained there without pulling said blade out of the ground.

9. An apparatus according to claim 8 wherein said guide means includes said track and a pin associated with said sheave and slidable in said track to guide said sheave slidably between said first and second positions.

10. An apparatus according to claim 9 wherein said guide pin is coaxial with said sheave.

11. An apparatus according to claim 7 wherein said guide means includes a track and a pin associated with said sheave and slidable in said track to guide said sheave slidably between said first and second positions.

12. An apparatus according to claim 11 wherein said guide pin is coaxial with said sheave.

13. An apparatus as in claim 8 comprising support means for said sheave including upper and lower links, one end of said lower link carrying said sheave, one end of said upper link being connected to said shoe, the other ends of said links being pivoted together, and drive means connected to one of said links for moving said links and thereby said sheave.

14. An apparatus as in claim 13 wherein said drive means comprises a cylinder connected to said shoe and having its piston connected to said upper link.

15. An apparatus as in claim 14 wherein said piston and cylinder combination is vertically placed relative to the ground and direction of laying cable.

16. An apparatus as in claim 15 wherein said cylinder is pivoted for movement relative to said shoe.

* * * * *